US010143253B2

(12) United States Patent
Faupel

(10) Patent No.: US 10,143,253 B2
(45) Date of Patent: Dec. 4, 2018

(54) MAGNETIC CUTTING SYSTEM AND METHOD

(71) Applicant: Ronald A. Faupel, St. Peters, MO (US)

(72) Inventor: Ronald A. Faupel, St. Peters, MO (US)

( * ) Notice: Subject to any disclaimer, the term of this patent is extended or adjusted under 35 U.S.C. 154(b) by 0 days.

(21) Appl. No.: 15/171,653

(22) Filed: Jun. 2, 2016

(65) Prior Publication Data

US 2016/0353822 A1 Dec. 8, 2016

Related U.S. Application Data

(60) Provisional application No. 62/169,857, filed on Jun. 2, 2015.

(51) Int. Cl.

| | |
|---|---|
| ***A41H 3/00*** | (2006.01) |
| ***B26B 29/06*** | (2006.01) |
| ***B26B 25/00*** | (2006.01) |

(52) U.S. Cl.

CPC ..... *A41H 3/00* (2013.01); *B26B 25/005* (2013.01); *B26B 29/06* (2013.01); *Y10S 33/01* (2013.01); *Y10S 211/01* (2013.01); *Y10S 428/90* (2013.01); *Y10T 83/748* (2015.04); *Y10T 83/875* (2015.04)

(58) Field of Classification Search

CPC ..... B26B 29/06; B26B 25/005; Y10T 83/748; Y10T 83/875; A41H 3/00; A41H 3/06; A41H 31/00; Y10S 33/01; Y10S 211/01; Y10S 428/90

USPC ..... 83/451, 565

See application file for complete search history.

(56) References Cited

U.S. PATENT DOCUMENTS 825,915 A * 7/1906 Lesh et al. ..... A41H 3/002 33/11
2,411,328 A * 11/1946 MacNab ..... A41H 3/06 2/243.1
2,497,332 A * 2/1950 Teetor ..... B43L 5/022 15/220.2
2,659,169 A * 11/1953 Brennan ..... A44C 17/0216 206/818
2,935,936 A * 5/1960 Woodring ..... B05C 17/06 101/128.1
3,381,864 A * 5/1968 Shields ..... D06F 59/02 211/119
3,746,992 A * 7/1973 Serembe ..... B43L 5/022 33/DIG. 1
3,826,170 A * 7/1974 Jones ..... B26D 7/2614 76/107.8
3,837,084 A * 9/1974 Johnson ..... A41H 3/00 269/8
3,949,629 A * 4/1976 Johnson ..... A41H 3/00 248/500
4,132,018 A * 1/1979 Hughes ..... G09F 1/10 248/126

(Continued)

FOREIGN PATENT DOCUMENTS

DE 29900716 U1 * 11/1999 ..... B03C 1/284

*Primary Examiner* — Laura M Lee

(74) *Attorney, Agent, or Firm* — Adam Bagwell; Bagwell IP

(57) ABSTRACT

A magnetic cutting system includes a magnetic cutting mat assembly. The magnetic cutting mat assembly includes a cutting mat, and a magnetic layer attached to the cutting mat. Magnets releasably attach to the magnetic cutting assembly. A grain alignment guide having at least one opening receives one of magnets to secure the grain alignment guide to the magnetic cutting assembly.

2 Claims, 10 Drawing Sheets

Magnetic Layout And Cutting System For Fabric And Patterns

Fabric And Pattern Layout Ready For Cutting

(56) References Cited

U.S. PATENT DOCUMENTS

| | | | | | |
|---|---|---|---|---|---|
| 4,274,459 | A * | 6/1981 | Galajda | B23Q 35/42 | 144/144.1 |
| 4,287,676 | A * | 9/1981 | Weinhaus | G09F 7/18 | 248/206.5 |
| 4,345,383 | A * | 8/1982 | Corsette | B43L 7/0275 | 33/474 |
| 4,538,354 | A * | 9/1985 | Smolik | B23B 47/28 | 33/563 |
| 4,930,382 | A * | 6/1990 | Collins | A41H 3/00 | 33/17 R |
| 5,000,688 | A * | 3/1991 | Clamp | G09B 11/04 | 101/127 |
| 5,444,920 | A * | 8/1995 | Nelson | A41H 3/002 | 33/11 |
| 6,931,750 | B1 * | 8/2005 | Lee | B26D 7/015 | 33/563 |
| 7,827,701 | B2 * | 11/2010 | Wharton | B43L 13/201 | 33/562 |
| 7,895,760 | B1 * | 3/2011 | Bareis | B43L 7/00 | 33/483 |
| 9,617,682 | B2 * | 4/2017 | Pelland | D06H 7/00 | |
| 2003/0116001 | A1 * | 6/2003 | Potter | B26B 29/06 | 83/522.11 |
| 2007/0193049 | A1 * | 8/2007 | Vetromila | G01B 3/04 | 33/436 |
| 2008/0028901 | A1 * | 2/2008 | Johnson | B26D 7/025 | 83/13 |
| 2010/0162863 | A1 * | 7/2010 | Johnson | B26B 29/06 | 83/23 |
| 2011/0132159 | A1 * | 6/2011 | Goodman, Jr. | B23K 10/00 | 83/13 |
| 2016/0353822 | A1 * | 12/2016 | Faupel | A41H 3/00 | |

* cited by examiner

ROTARY CUTTING MAT

CORK OPTION FOR PATTERN MAKERS

Magnetic Layout And Cutting System
For Fabric And Patterns

Neodymium Magnets
¾" Dia. X ⅛" & ¼" Thick Discs

Rotary Cutting Mat With Sheet Metal Panel
( 24" x 36" Shown )

Magnetic Layout And Cutting System
For Fabric And Patterns

Fabric And Pattern Layout Ready For Cutting

Multiple Cutting Mat Option For Larger Patterns

LOW PROFILE MAGNET FOR PATTERN LAYOUT AND CUTTING SYSTEM

Actual size

Space saving stackable design

FABRIC GRAIN ALIGNMENT GUIDE WITH LARGER LIP AREA

36" Length shown. Also available in 24" length.

PATTERN MAKERS SQUARE

MAGNETIC CUTTING SYSTEM AND METHOD

FIELD OF THE INVENTION

The present invention generally relates to sewing systems and methods, and more specifically to methods and apparatus for cutting fabric for sewing and pattern design.

BACKGROUND

When making garments, typically pattern pieces are pinned to fabric for cutting the fabric in the shape of the pattern pieces. Pinning the pattern pieces to the fabric is a time-consuming process, and a user may often stab themselves with the pins, especially when pinning fabrics with a tight denier or lofty fabrics. In addition, pinning can often buckle the pattern pieces, resulting in inaccurate cutting of the fabric. Furthermore, during cutting, the fabric (especially knits, silks, and sheers) may move on the cutting surface, resulting in inaccurate cutting of the fabric.

BRIEF DESCRIPTION OF THE DRAWINGS

Corresponding reference characters indicate corresponding parts throughout the drawings.

DETAILED DESCRIPTION

Figure 1:
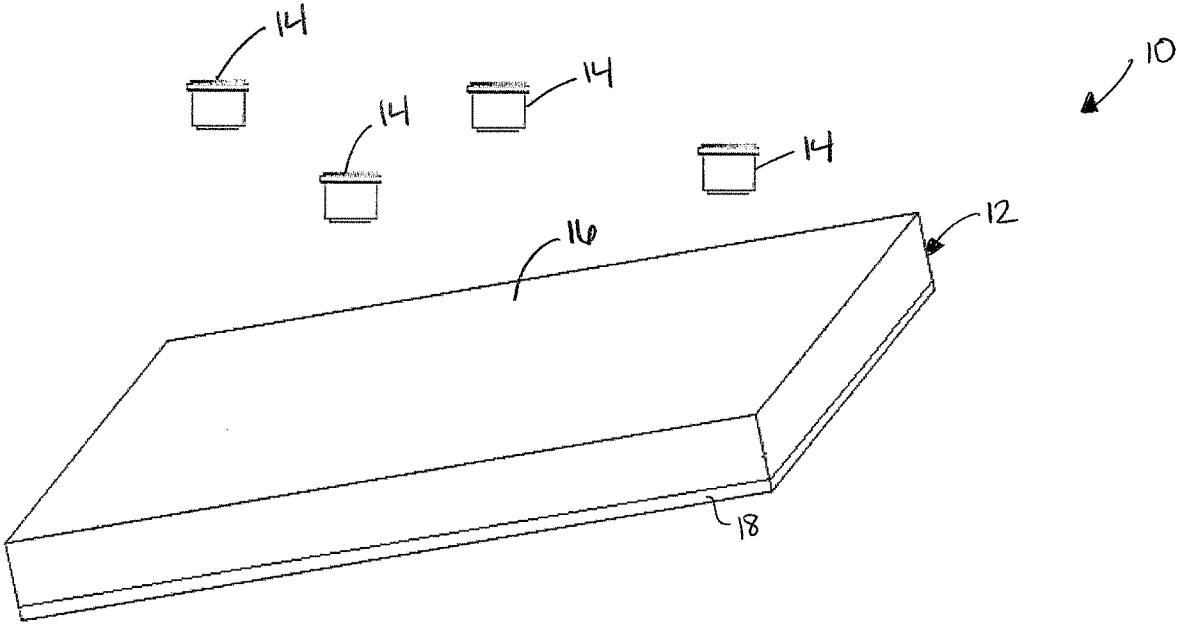
FIG. 1 is a schematic perspective of a magnetic cutting system, including a magnetic cutting mat assembly and magnets.
Figure 2:
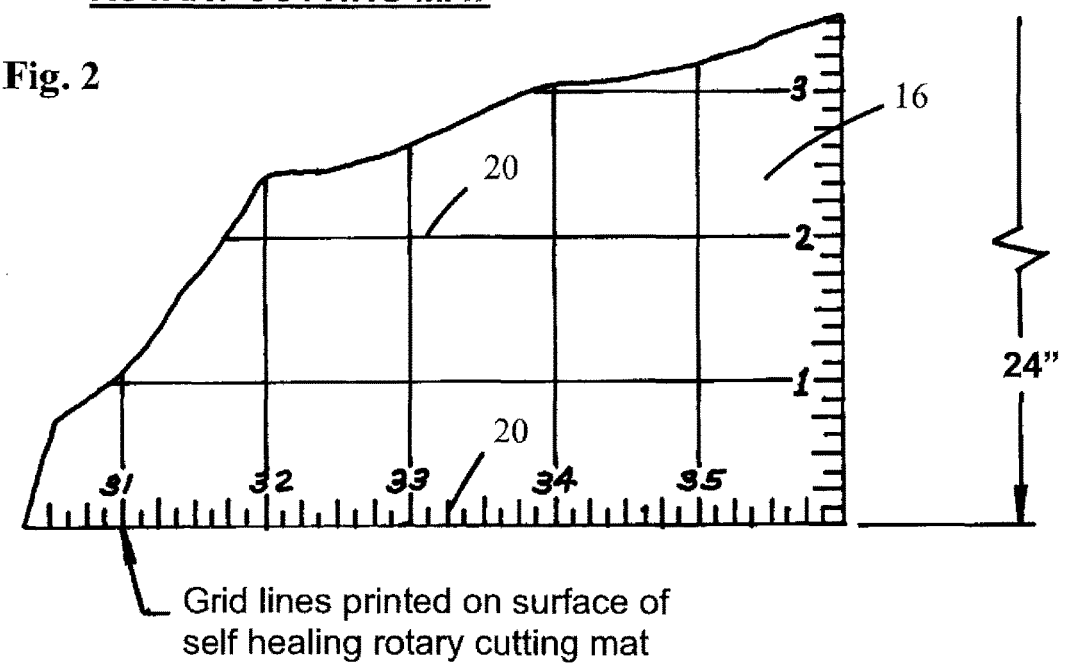
FIG. 2 is a partial top plan of the magnetic cutting mat assembly.
Figure 3:
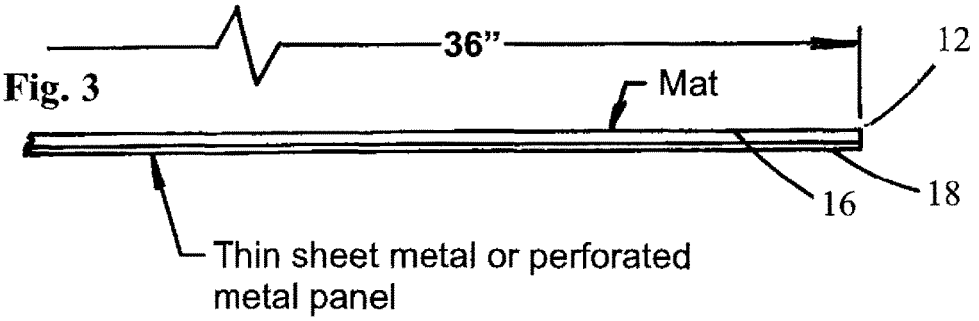
FIG. 3 is a partial side elevation of the magnetic cutting mat assembly.

Referring to FIGS. 1-8, a magnetic cutting system is generally indicated at 10. The magnetic cutting system 10 includes a magnetic cutting mat assembly 12 and magnets 14. Optionally, the magnetic cutting system 10 can include additional accessories for use with the magnetic cutting mat assembly 12 and magnets 14, as described below.

The magnetic cutting mat assembly 12 includes a cutting mat 16 and a magnetic layer 18 attached to the cutting mat. The cutting mat 16 can be formed of wood, cork, plastic, rubber, metal, glass, PVC, or any other material suitable for use with a rotary cutter or other cutting device. Preferably, the cutting mat 16 is self-healing. The cutting mat 16 can include markings 20 such as grid lines, angles, circles, or any other design or shape in any orientation, scale, frequency, or pattern suitable for reference during use of the magnetic cutting mat assembly 12. In one embodiment, the cutting mat 16 includes 1" grid lines that extend to the edges of the mat and 30°, 45°, and 60° slope lines. The cutting mat 16 can be any suitable size and shape for the desired application. For example, the cutting mat 16 can be rectangular and may be 12"×18", 18"×24", or 24"×36", although other configurations are within the scope of the present invention. In one embodiment, the cutting mat 16 is a multi-layer self-healing cutting mat sold by Clover Needlecraft of Ontario, Calif.

The magnetic layer 18 can be formed from any material that is attracted to magnets, such as a ferromagnetic material, including iron, nickel, and cobalt alloys. In one embodiment, the magnetic layer 18 is made of a steel or other sheet metal panel. The sheet metal panel can be solid, or can be perforated to reduce the weight of the cutting mat assembly 12. The magnetic layer 18 adds structural strength and stiffness to the cutting mat assembly 12, thereby permitting a thin cutting mat 16 to be used in the assembly if desired. The magnetic layer 18 can be the same size and shape as the cutting mat 16, although other configurations are within the scope of the present invention. For example, the magnetic layer 18 may extend under only a portion of the cutting mat 16, or may extend beyond the cutting mat in one or more directions. Preferably, the magnetic layer 18 is a steel sheet metal panel that extends substantially to the edges of the cutting mat 16. This configuration permits multiple mat assemblies to be positioned adjacent each other to form a substantially continuous magnetic layer with substantially no breaks between the adjacent cutting mat assemblies (see, e.g., FIG. 8).

The magnetic layer 18 is secured to the cutting mat 16 in any suitable manner. For example, the magnetic layer 18 can be adhered to the cutting mat 16 with tape, glue, or any suitable adhesive. Alternatively, the magnetic layer 18 can be fastened to the cutting mat 16 with fasteners. If the cutting mat 16 is made of plastic, the magnetic layer 18 can be embedded in the plastic during forming of the cutting mat. Other configurations and methods for attaching the magnetic layer 18 to the cutting mat 16 are within the scope of the present invention.

Figure 4:
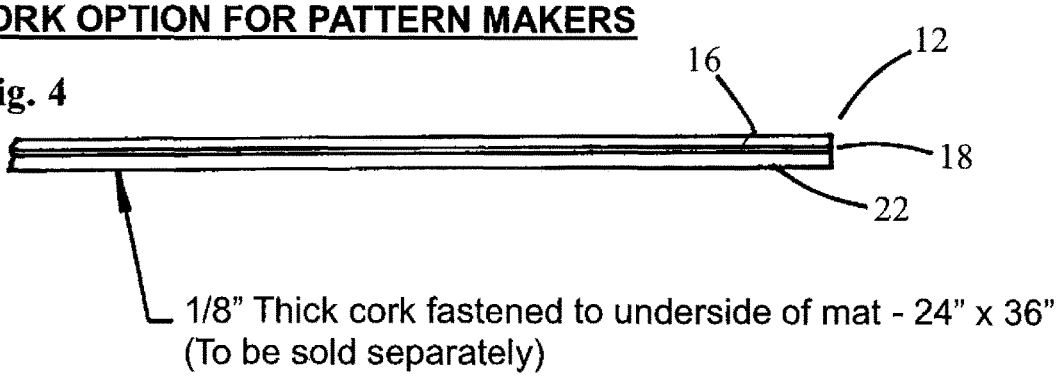
FIG. 4 is a partial side elevation of the magnetic cutting mat assembly with a patternmaking layer attached thereto.

Optionally, the magnetic cutting mat assembly 12 can include additional layers. For example, as illustrated in FIG. 4, a patternmaker layer 22 can be secured to the magnetic layer 18 opposite the cutting mat 16. The patternmaker layer 22 can be cork, or any other suitable material for use as a surface for drawing and cutting sewing pattern pieces. The patternmaker layer 22 is secured to the magnetic layer 18 in any suitable manner, such as adhered (e.g., by tape, glue, etc.) or attached with fasteners. In one embodiment, the patternmaker layer 22 is attached to the magnetic layer 18 by hook-and-loop fasteners. The patternmaker layer 22 can be the same size and shape as the cutting mat 16 and/or the magnetic layer 18, although other configurations are within the scope of the present invention. For example, the patternmaker layer 22 may extend under only a portion of the cutting mat 16 and/or the magnetic layer 18, or may extend beyond the cutting mat and magnetic layer in one or more directions. In one embodiment, the patternmaker layer 22 is a ⅛" thick cork mat of the same size and shape as the cutting mat 16 and the magnetic layer 18 (e.g., 24"×36"). The magnetic cutting mat assembly 12 can be sold with the patternmaker layer 22 attached (either permanently or temporarily), or the patternmaker layer can be sold as a separate accessory for use with the magnetic cutting mat assembly. It is understood that the patternmaker layer 22 can be omitted within the scope of the present invention.

Figure 9A:
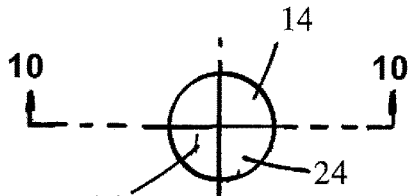
FIG. 9A is a top plan of an embodiment of a low profile magnet of the magnetic cutting assembly.
Figure 9B:
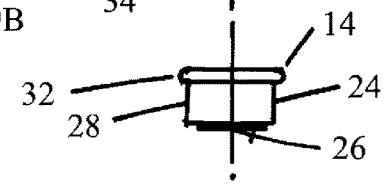
FIG. 9B is a side elevation thereof.
Figure 11:
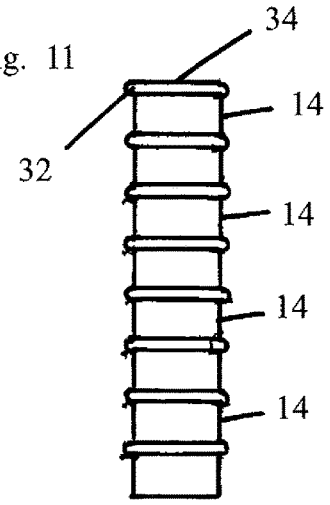
FIG. 11 is a side elevation of multiple low profile magnets stacked together.
Figure 10:
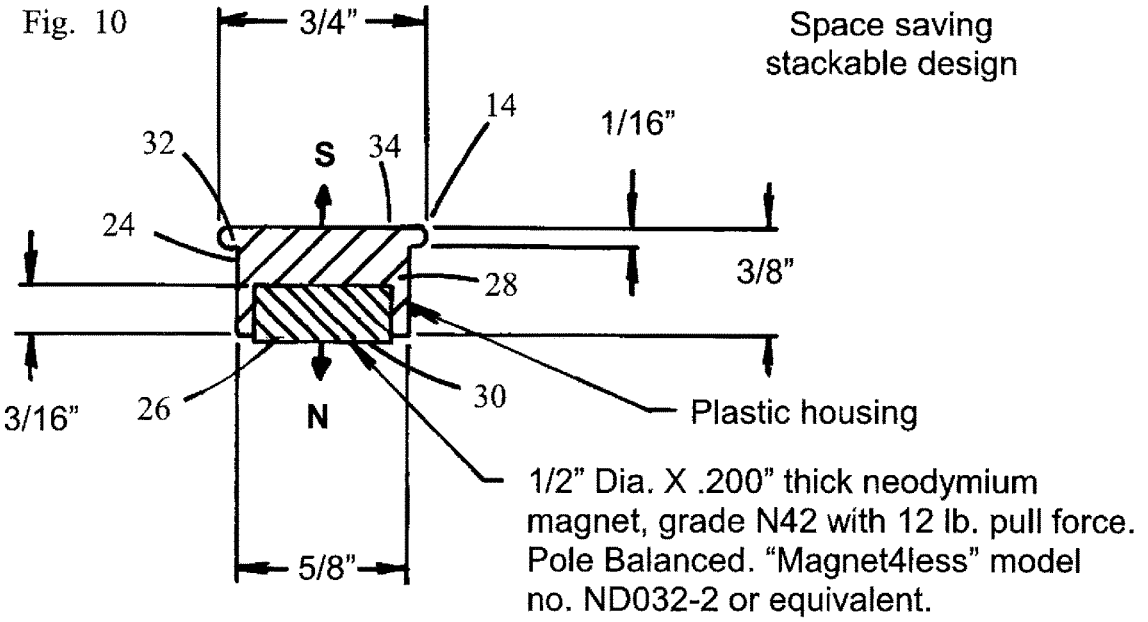
FIG. 10 is a cross section taken along line 10-10 of FIG. 9A.

The magnets 14 are configured to be magnetically attracted to the magnetic layer 18 to secure items (such as fabric F, pattern pieces P, accessories, and the like) to the cutting mat assembly 12. As shown in FIGS. 9A, 9B, and 10, the magnets 14 include a magnet housing 24 and a magnet base 26 received in or otherwise attached to the magnet housing. The magnet base 26 is preferably a conventional permanent magnet, although other types of magnets are within the scope of the present invention. In one embodiment, the magnet base 26 is a rare earth magnet such as a neodymium magnet or a samarium-cobalt magnet. The magnet base 26 can be a neodymium disc magnet of any suitable size. For example, the magnet base 26 can be a neodymium disc magnet having a diameter of ½" or ¾" and a thickness of ⅛", ⅕", or ¼". The magnet base 26 should have sufficient attraction strength or pull force to securely attach items to the magnetic cutting mat assembly 12. Preferably, the pull force of the magnet base 26 is at least 0.90 pounds, and more preferably is at least 1.20 pounds. In one embodiment, the magnet base 26 has a pull force of about 12 pounds. Magnets with higher or lower pull forces may be necessary depending on the thickness of the cutting mat 16 or the items to be secured to the cutting mat, as the pull force increases with closer proximity to the magnetic layer 18. Accordingly, if the cutting mat 16 or item being held is thicker (i.e., the magnet base 26 is farther away from the magnetic layer 18 when in use), the magnet base may require a higher pull force than if the cutting mat or item being held is thinner (i.e., the magnet base is closer to the magnetic layer when in use).

Figure 5:
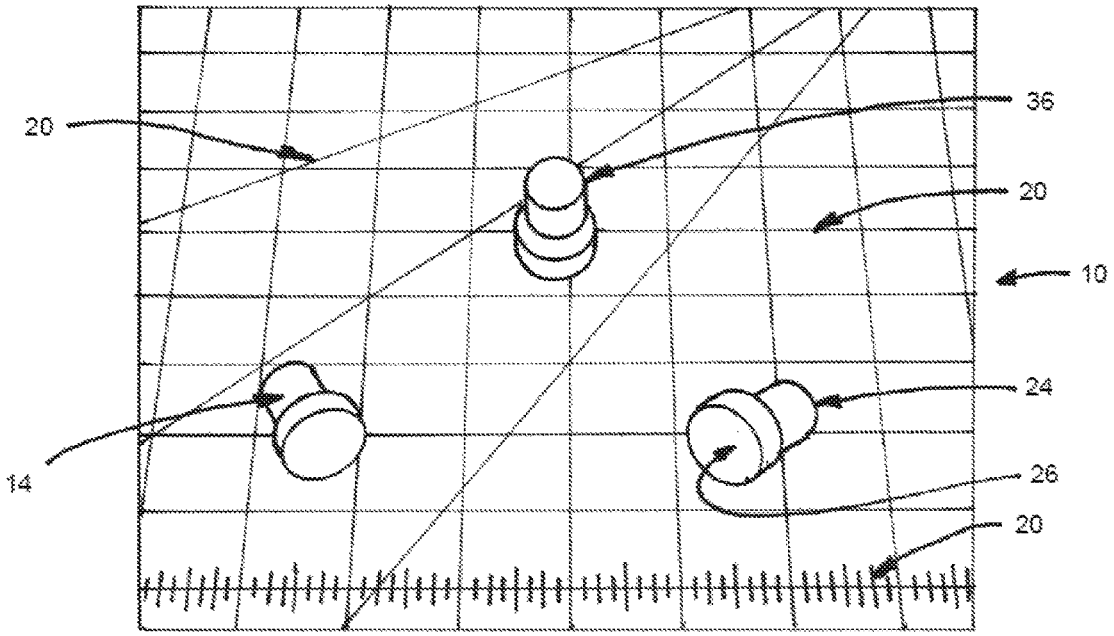
FIG. 5 is a photograph of an exemplary magnetic cutting system including magnets with knobs.
Figure 6:
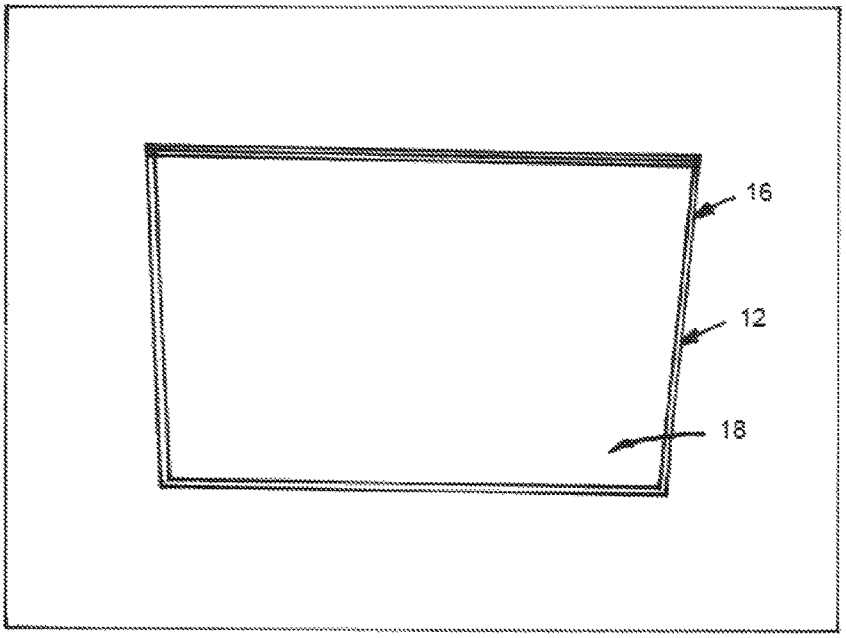
FIG. 6 is a photograph of an exemplary magnetic cutting mat assembly.
Figure 7:
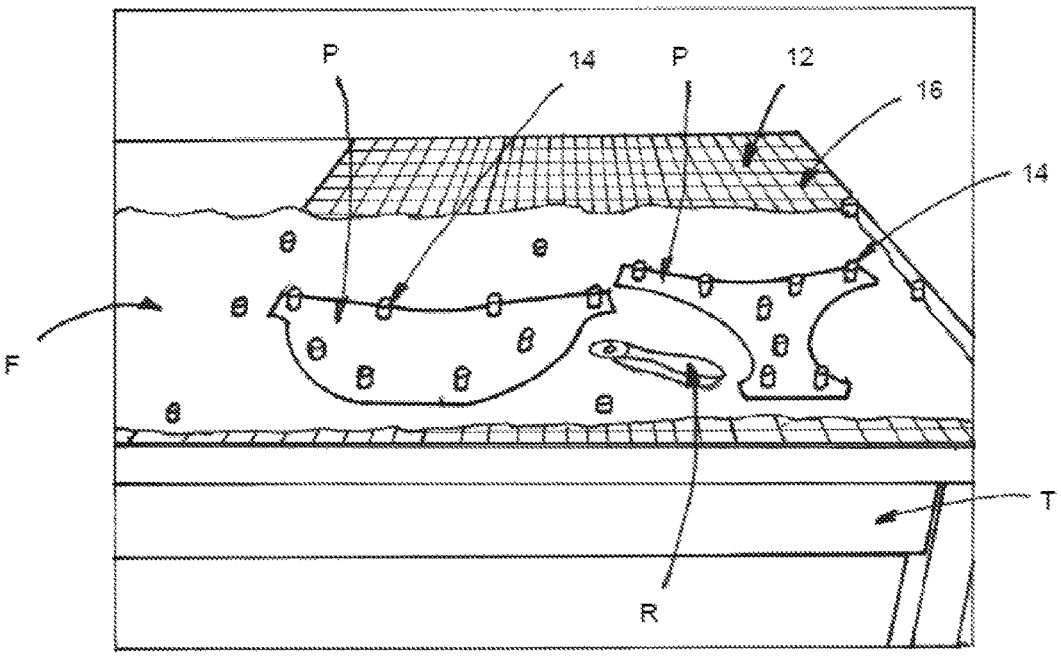
FIG. 7 is a photograph of the magnetic cutting system holding fabric and pattern pieces.
Figure 8:
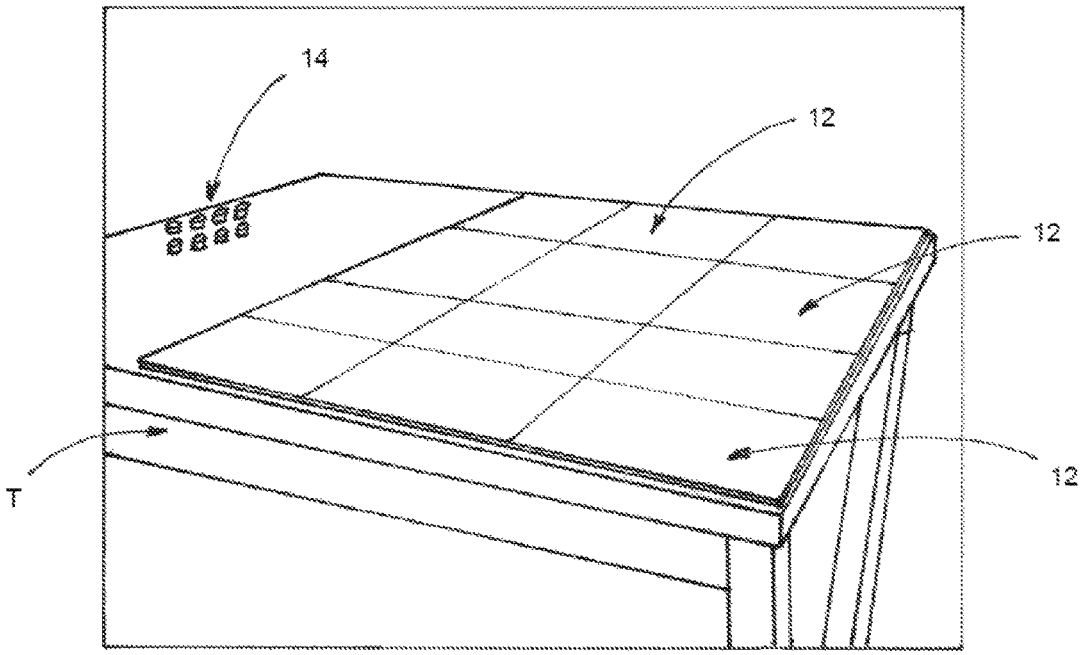
FIG. 8 is a photograph of multiple magnetic cutting assemblies positioned adjacent each other.

In the embodiment illustrated in FIGS. 1 and 9A-11, the magnet housing 24 is a low profile magnet housing made of plastic or other suitable material that will not interfere with the magnet base 26. The low profile magnet housing 24 includes an annular side wall 28 having a cavity 30 configured to receive at least a portion of the magnet base 26. An annular flange 32 extends outward from the side wall 28 at a top end of the housing 24 to provide a gripping surface for the user. The housing 24 includes a substantially flat top surface 34. The magnet base 26, preferably a neodymium disc magnet, is received in the cavity 30 of the housing 24 in a pole-balanced orientation, as illustrated in FIG. 10. Optionally, the bottom of the magnet base 26 extends below the side wall 28 of the magnet housing 24. Because of the pole-balanced orientation of the magnet base 26 and the substantially flat top surface 34 of the housing 24, the low profile magnets 14 illustrated in FIGS. 1 and 9A-11 are easily stackable for packaging and storage. The low profile magnets 14 do not interfere with use of the magnetic cutting mat assembly 12. For example, movement of a user's hand (e.g., when using a rotary cutter to cut fabric positioned on the cutting mat) is not impeded by the low profile magnets 14. However, other configurations for the magnets 14 are within the scope of the present invention, such as the magnet housing 24 including a knob 36 for easy grasping, as illustrated in FIG. 5.

Figure 12:
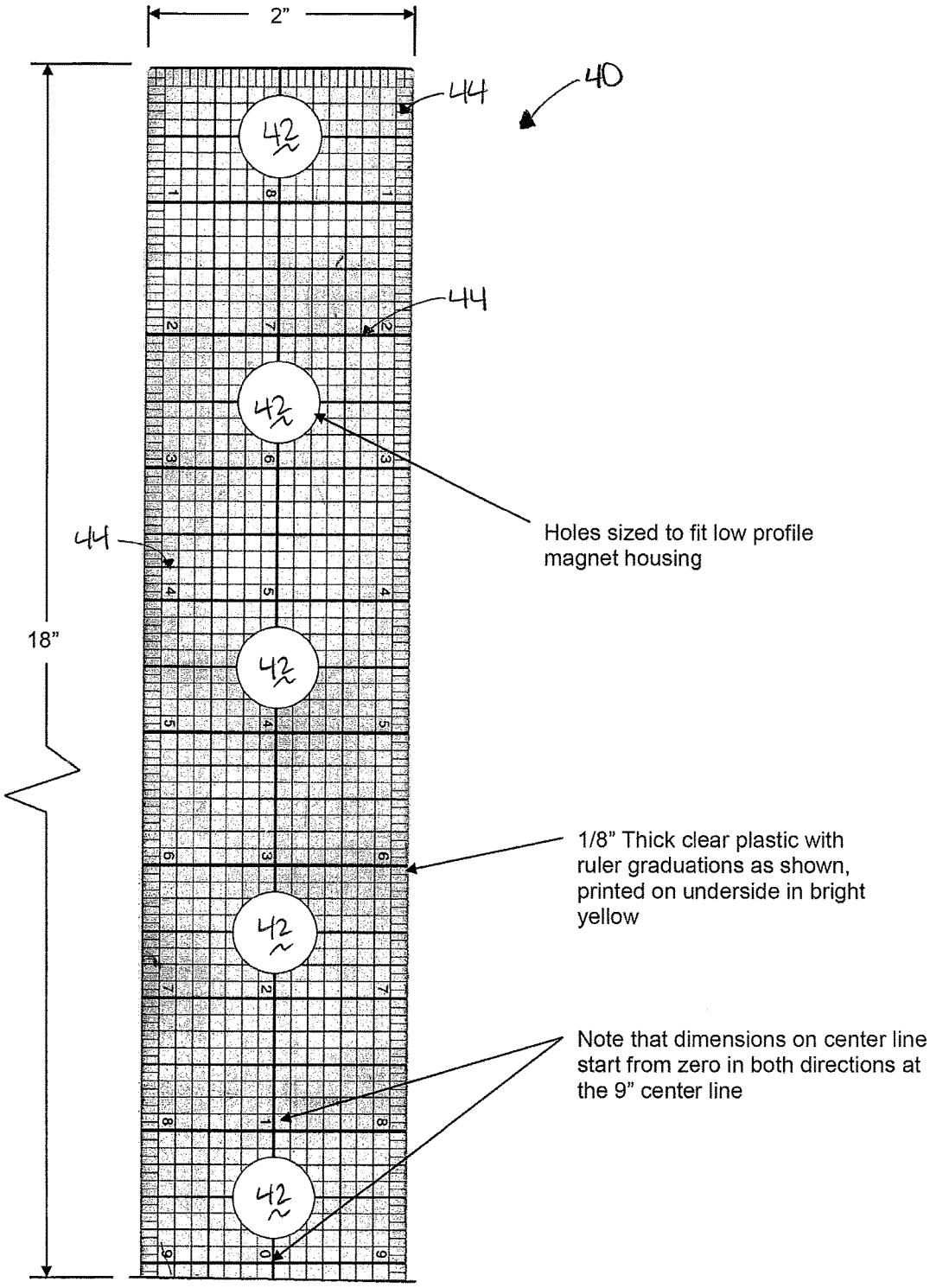
FIG. 12 is a top plan of a patternmaker ruler for use with the magnetic cutting system.

The magnetic cutting system 10 can optionally include additional accessories configured for use with the magnetic cutting mat assembly 12 and the magnets 14. As seen in FIG. 12, a sewing or patternmaker ruler 40 for use with the magnetic cutting system 10 includes at least one opening 42 extending through the ruler sized and shaped to receive one of the magnets 14. The patternmaker ruler 40 is used to create straight edges, to square corners, to measure straight lines, and to walk pattern edges (i.e., to check pattern seam lines to make sure pattern pieces match up with each other). As illustrated, the ruler 40 includes multiple openings 42 configured to receive the low profile magnets 14. The openings 42 are spaced along a length of the ruler. Magnets 14 can be placed in one or more of the openings 42 to secure the ruler 40 to the magnetic cutting mat assembly 12. For example, magnets 14 can be placed in multiple openings 42 to secure the ruler 40 to the magnetic cutting mat assembly 12 along the entire length of the ruler. Alternatively, a single magnet 14 can be placed in a select one of the openings 42 and used as a pivot point for moving the ruler 40. The patternmaker ruler 40 can be of any suitable size for drawing, measuring, and cutting fabric and patterns, such as 18" long by 2" wide with a thickness of ⅛", as illustrated. The ruler 40 can be made of any suitable material such as plastic, glass, metal, wood, or other materials. Preferably, the ruler 40 is translucent, transparent, or semi-transparent. In one embodiment, the ruler 40 is made of transparent plastic such as acrylic and includes markings 44 (including measurements and grid lines) printed on a surface (e.g., on the top surface and/or on the underside) of the ruler. For example, the markings 44 can be printed on the underside of the ruler 40 in a highly visible color, such as yellow. The markings 44 can include measurements in U.S. units, metric units, or a combination, and the ruler 40 can include multiple measurements starting from zero at opposing ends of the ruler.

Figure 13:
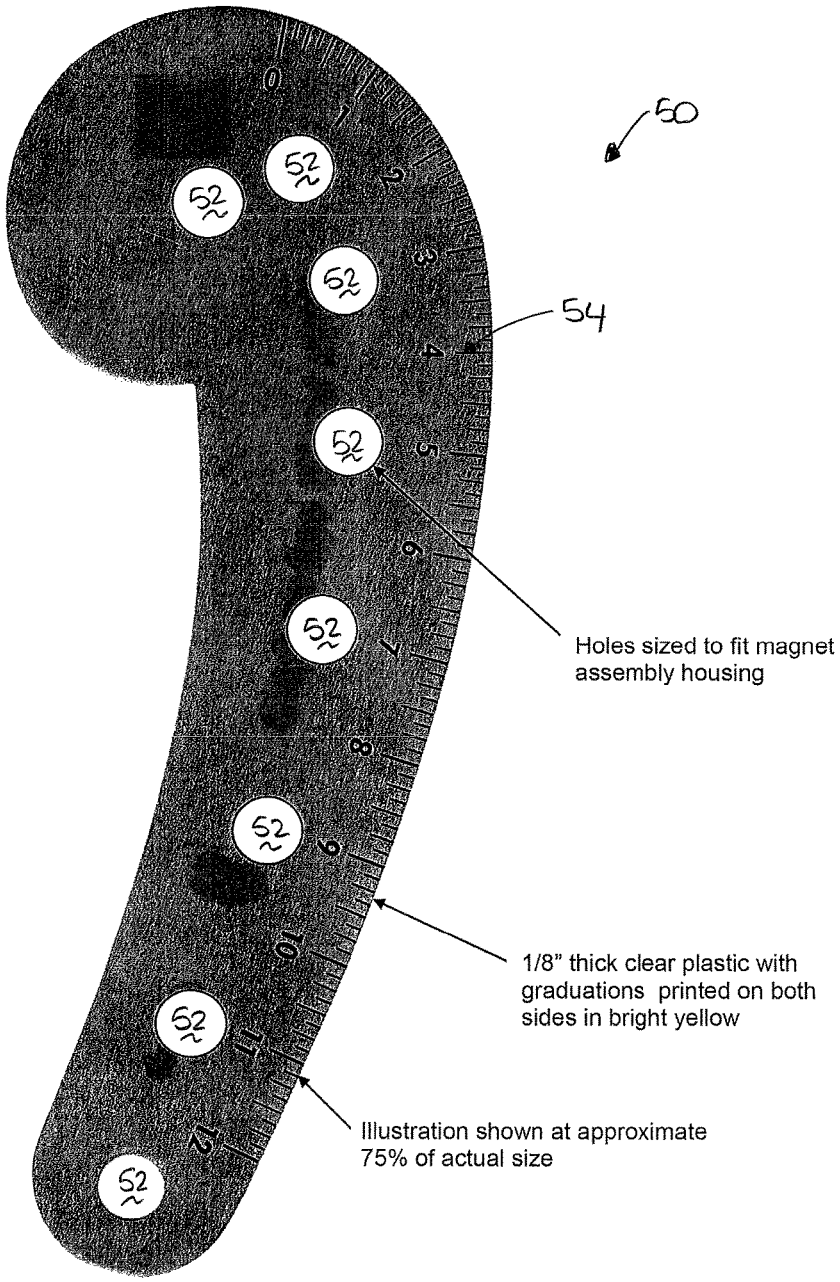
FIG. 13 is a top plan of a patternmaker curve for use with the magnetic cutting system.

As seen in FIG. 13, a patternmaker curve 50 for use with the magnetic cutting system 10 includes at least one opening 52 extending through the curve sized and shaped to receive one of the magnets 14. The patternmaker curve 50 is used to create curves and small details in patterns. The curve 50 is used for smaller curves, such as neckline, bust line, armholes, swimwear leg lines, crotch curves, sleeve caps, princess seams, collars, and other design lines. The curve 50 has an arc of varying degree to provide options and ensure maximum fit and design creativity. As illustrated, the curve 50 includes multiple openings 52 configured to receive the low profile magnets 14. The openings 52 are spaced along a length of the curve 50. Magnets 14 can be placed in one or more of the openings 52 to secure the curve 50 to the magnetic cutting mat assembly 12. For example, magnets 14 can be placed in multiple openings 52 to secure the curve 50 to the magnetic cutting mat assembly 12 along the entire length of the curve. Alternatively, a single magnet 14 can be placed in a select one of the openings 52 and used as a pivot point for moving the curve 50. The patternmaker curve 50 can be of any suitable size for drawing, measuring, and cutting fabric and patterns, such as a 12" curve with a thickness of ⅛", as illustrated. The curve 50 can be made of any suitable material such as plastic, glass, metal, wood, or other materials. Preferably, the curve 50 is translucent, transparent, or semi-transparent. In one embodiment, the curve 50 is made of transparent plastic such as acrylic and includes markings 54 (including measurements) printed on a surface (e.g., on the top surface and/or on the underside)

of the curve. For example, the markings 54 can be printed on both the top surface and the underside of the curve 50 in a highly visible color, such as yellow. The markings 54 can include measurements in U.S. units, metric units, or a combination thereof.

Figure 14:
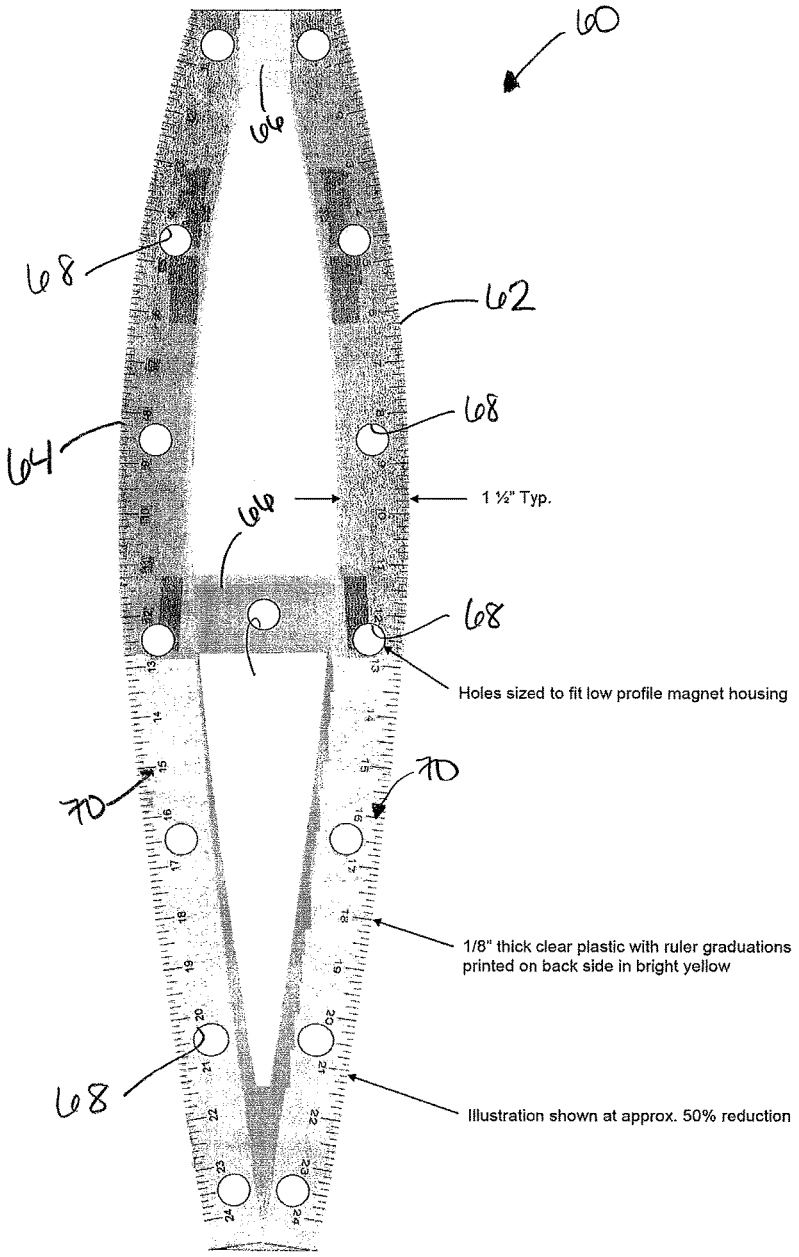
FIG. 14 is a top plan of a patternmaker hip curve for use with the magnetic cutting system.

A patternmaker hip curve 60 for use with the magnetic system 10 is illustrated in FIG. 14. The hip curve 60 has a first hip curve side 62 for use in making one side of a pattern and a second hip curve side 64 for use in making the other side of the pattern. Typical hip curves include only one side, and must be flipped over for use on the right and left sides of a pattern. The double-sided hip curve 60 includes two mirror image hip curve sides joined together at one or more bridges 66. This configuration makes it easy to draw patterns (e.g., pant leg inseams and side seams, hemlines, curve of bodices, hiplines of skirts and dresses). In addition, the hip curve 60 can have a tighter curve at one end for use in drawing armholes, necklines, and other smaller curves. The double-sided hip curve 60 facilitates drawing smooth and even curves that are balanced for both sides of the pattern. For example, the right hip and left hip curve of a skirt or pants can be drawn without flipping the hip curve 60 over, making it easier to see all of the pertinent markings as the curve is moved from side to side and easier to ensure symmetric curves are drawn.

The hip curve 60 includes at least one opening 68 extending through the hip curve sized and shaped to receive one of the magnets 14. As illustrated, the hip curve 60 includes multiple openings 68 configured to receive the low profile magnets 14. The openings 68 are spaced along a length of the hip curve 60. Magnets 14 can be placed in one or more of the openings 68 to secure the hip curve 60 to the magnetic cutting mat assembly 12. For example, magnets 14 can be placed in multiple openings 68 to secure the hip curve 60 to the magnetic cutting mat assembly 12 along the entire length of the hip curve. Alternatively, a single magnet 14 can be placed in a select one of the openings 68 and used as a pivot point for moving the hip curve 60. The patternmaker hip curve 60 can be of any suitable size for drawing, measuring, and cutting fabric and patterns, such as a 24" curve with the curve sides having a width of 1½" and a thickness of ⅛", as illustrated. The hip curve 60 can be made of any suitable material such as plastic, glass, metal, wood, or other materials. Preferably, the hip curve 60 is translucent, transparent, or semi-transparent. In one embodiment, the hip curve 60 is made of transparent plastic such as acrylic and includes markings 70 (including measurements) printed on a surface (e.g., on the top surface and/or on the underside) of the hip curve. For example, the markings 70 can be printed on the underside of both the first and second sides 62, 64 of the hip curve 60 in a highly visible color, such as yellow. The markings 70 can include measurements in U.S. units, metric units, or a combination, and the hip curve 60 can include multiple measurements starting from zero at opposing ends of the ruler. Although a double-sided hip curve is illustrated, it is understood that other configurations are within the scope of the present invention, such as a typical one-sided hip curve having openings configured to receive the magnets. In addition, although the hip curve 60 is described and illustrated with openings 68 for use with the magnetic system 10, it need not include the openings, and can be used in conventional cutting or design systems as well.

Figure 15:
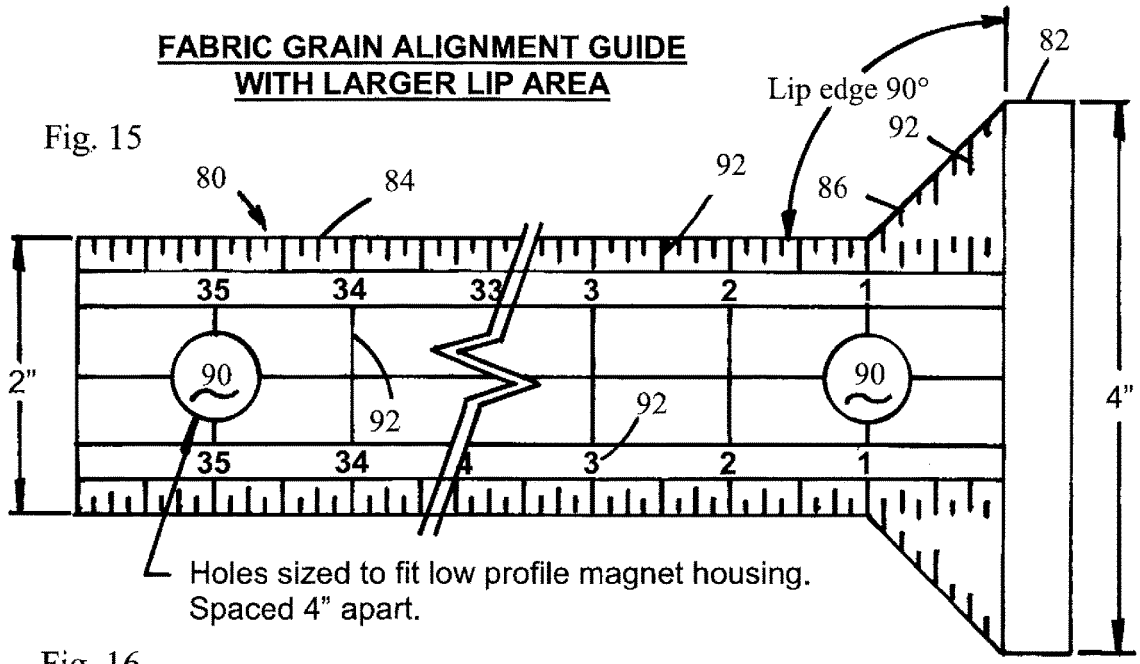
FIG. 15 is a top plan of a grain alignment guide for use with the magnetic cutting system.
Figure 16:
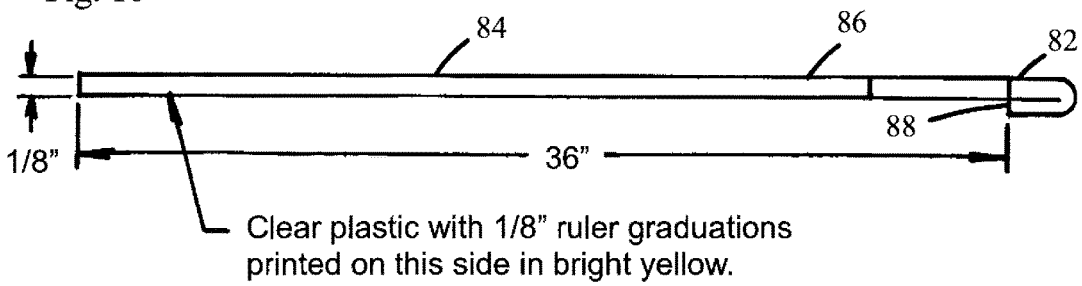
FIG. 16 is a side elevation of the grain alignment guide.
Figure 17:
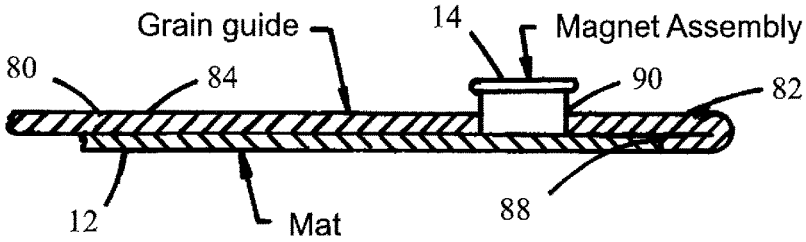
FIG. 17 is a side elevation illustrating use of the grain alignment guide with the cutting mat assembly and magnet.

A T-square ruler or grain alignment guide 80 is illustrated in FIGS. 15-17. The guide 80 is used in aligning the grain line printed on sewing pattern pieces with the grain line of the fabric F. The grain alignment guide 80 includes a base portion 82 having a first width, a ruler portion 84 having a second width narrower than the first width, and a transition portion 86 extending between the base and the ruler portions. In the illustrated embodiment, the width of the base portion 82 is about 4", and the width of the ruler portion 84 is about 2". The transition portion 86 is preferably angled at about 45°, although other configurations are within the scope of the present invention. The base portion 82 includes a lip edge 88 configured to engage the edge of the cutting mat or the edge of a table to align the guide 80. The lip edge 88 extends in a plane below the plane including the remainder of the guide 80.

The guide 80 includes at least one opening 90 extending through opposite faces of the guide sized and shaped to receive one of the magnets 14. As illustrated, the guide 80 includes multiple openings 90 configured to receive the low profile magnets 14. The openings 90 are spaced along a length of the guide 80. Magnets 14 can be placed in one or more of the openings 90 to secure the guide 80 to the magnetic cutting mat assembly 12. For example, magnets 14 can be placed in multiple openings 90 to secure the guide 80 to the magnetic cutting mat assembly 12 along the entire length of the guide. Alternatively, a single magnet 14 can be placed in a select one of the openings 90 and used as a pivot point for moving the guide 80. The grain alignment guide 80 can be of any suitable size for drawing, measuring, aligning, and cutting fabric and patterns, such as 24" or 36" long with a thickness of ⅛", as illustrated. The guide 80 can be made of any suitable material such as plastic, glass, metal, wood, or other materials. Preferably, the guide 80 is translucent, transparent, or semi-transparent. In one embodiment, the guide 80 is made of transparent plastic such as acrylic and includes markings 92 (including measurements and grid lines) printed on a surface (e.g., on the top surface and/or on the underside) of the guide. For example, the markings 92 can be printed on the underside of the guide 80 in a highly visible color, such as yellow. The markings 92 can include measurements in U.S. units, metric units, or a combination, and the guide 80 can include multiple measurements starting from zero at opposing ends of the ruler portion. In the illustrated embodiment, the guide 80 includes markings 92 on both the ruler and transition portions 84, 86. The markings 92 include measurements starting from zero at the base portion 82 on both sides of the guide 80, although one side can include measurements starting from zero at the opposite end of the guide, or only one side can include markings. Although the guide 80 is described and illustrated with openings 90 for use with the magnetic system 10, it need not include the openings and can be used in conventional cutting systems as well.

Figure 18:
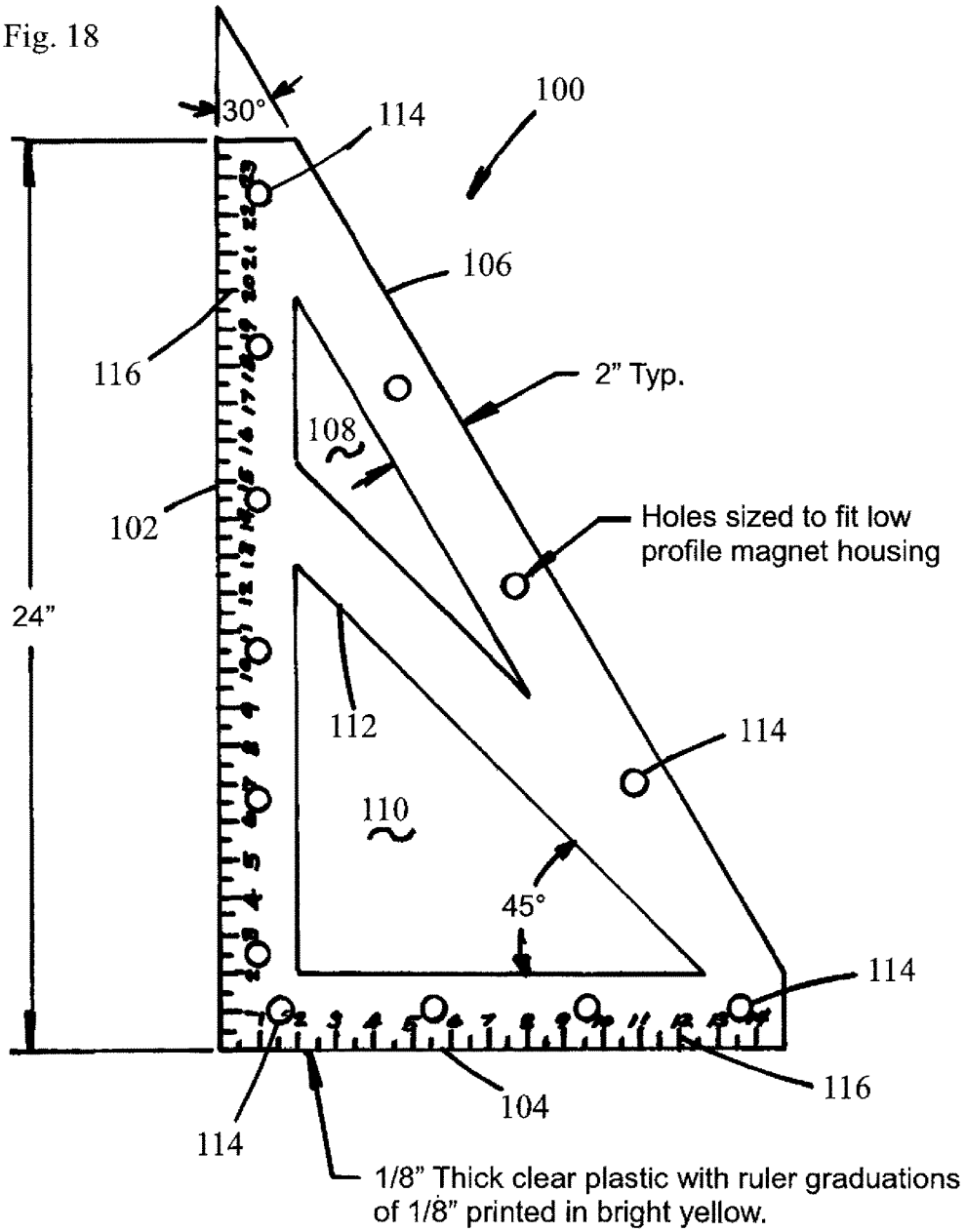
FIG. 18 is a top plan of a patternmaker square for use with the magnetic cutting system.

An L-square ruler or patternmaker square 100 is illustrated in FIG. 18. The square 100 is used to draw fashion designs and patterns. The square 100 includes a first side portion 102, a second side portion 104, and a third side portion 106 extending between the first and second side portions and forming a generally triangular shape. The first and second side portions 102, 104 are perpendicular to each other. Conventional patternmaker squares either have only a single internal opening defined by the side portions, or omit the third side portion altogether. The illustrated square 100 includes a first opening 108 and a second opening 110, separated by an internal portion 112. The first opening 108 is defined by a top edge of the internal portion 112 and internal edges of the first and third portions 102, 106. The second opening 110 is defined by a bottom edge of the internal portion 112 and internal edges of the first and second portions 102, 104. The addition of the internal portion 112 adds increased functionality to the square 100 by forming additional angles for assisting a user in drawing fashion designs and patterns. The square 100 includes the typical 90° angle between the first and second portions 102, 104, and additionally includes 45° angles (e.g., in the second opening 110 and the first opening 108) and a 30° angle (e.g., in the first opening 108), making it a more versatile tool for use in drawing designs and patterns.

The square 100 includes at least one opening 114 extending through the square sized and shaped to receive one of the magnets 14. As illustrated, the square 100 includes multiple openings 114 configured to receive the low profile magnets 14. The openings 114 are spaced along a length of each side portion 102, 104, 106 of the square 100. The internal portion 112 can also include openings (not shown). Magnets 14 can be placed in one or more of the openings 114 to secure the square 100 to the magnetic cutting mat assembly 12. For example, magnets 14 can be placed in multiple openings 114 to secure the square 100 to the magnetic cutting mat assembly 12 along the entire length and width of the square. Alternatively, a single magnet 14 can be placed in a select one of the openings 114 and used as a pivot point for moving the square 100. The patternmaker square 100 can be of any suitable size for drawing, measuring, aligning, and cutting fabric and patterns, such as 24" long with 2" wide side portions and a thickness of ⅛", as illustrated. The square 100 can be made of any suitable material such as plastic, glass, metal, wood, or other materials. Preferably, the square 100 is translucent, transparent, or semi-transparent. In one embodiment, the square 100 is made of transparent plastic such as acrylic and includes markings 116 (including measurements) printed on a surface (e.g., on the top surface and/or the underside) of the square. For example, the markings 116 can be printed on the underside of the square 100 in a highly visible color, such as yellow. The markings 116 can include measurements in U.S. units, metric units, or a combination, and the square 100 can include multiple measurements starting from zero at opposing ends of the side portions. In the illustrated embodiment, the square 100 includes markings 116 on both the first and second side portions 102, 104. The square 100 can also include markings on the third side portion 106 and/or the internal portion 112 (not shown). The markings 116 include measurements starting from zero at the intersection of the first and second side portions 102, 104, although other configurations are within the scope of the present invention. Although the square 100 is described and illustrated with openings 114 for use with the magnetic system 10, it need not include the openings and can be used in conventional cutting systems as well.

In use, a user lays fabric F on the magnetic cutting mat assembly 12. The assembly 12 is preferably supported on a surface such as a table T with the cutting mat 16 facing upward and the fabric F positioned on the cutting mat. Sewing pattern pieces P are placed over the fabric F and secured to the fabric and the cutting mat assembly 12 with magnets 14. The fabric F is also secured to the cutting mat assembly 12 by the magnets 14 holding the sewing pattern pieces P. Additional magnets 14 can also be used to secure the fabric F to the cutting mat assembly 12 independent of the pattern pieces P. The user then cuts the fabric F in the shape of the pattern pieces P with a rotary cutter R or other suitable device.

If the magnetic cutting system 10 includes the patternmaking accessories (e.g., the ruler 40, the curve 50, the hip curve 60, or the square 100) as described above, they can be implemented to assist a user in forming and using pattern pieces P, in aligning the pattern pieces on the mat and with the fabric F, and in cutting the fabric on the mat. In use, a user lays pattern paper (e.g., uncoated white butcher paper, or any other suitable patternmaking material) on the patternmaker layer 22. The patternmaking accessory is secured to the pattern paper and the cutting mat assembly 12 with magnets 14. The user then marks or cuts the pattern paper to form the sewing pattern piece P, using the patternmaking accessory as a guide. The patternmaking accessories can also be used to mark or cut fabric F secured to the cutting mat assembly 12, with or without using sewing pattern pieces P.

If the magnetic cutting system 10 includes the grain alignment guide 80 as described above, it can be implemented to assist a user in aligning and using pattern pieces P. In one exemplary embodiment, a user lays fabric F on the magnetic cutting assembly 12. The assembly is supported on a surface such as a table T with the cutting mat 16 facing upward. The fabric F is positioned on the cutting mat 16. The selvage of the fabric F is aligned along with gridline markings 20 on the mat 16 at the edge of the mat, and the fabric is straightened and smoothed as necessary to prepare for cutting. The fabric selvage edges can be held in place with magnets 14 to keep the fabric F from moving relative to the cutting mat assembly 12. A sewing pattern piece P is placed on the fabric F. The pattern piece P is positioned on the fabric F so that the pattern grain line is approximately parallel to the fabric selvage. The grain alignment guide 80 is placed on an edge of the cutting mat 16 perpendicular to the selvage and a first end of the pattern grain line. The lip edge 88 engages the cutting mat assembly 12 or the table T to ensure the guide 80 remains in the aligned position. In addition, magnets 14 can be placed in openings 90 of the guide 80 to ensure the guide remains in the aligned position. Using the markings 92 on the guide 80, the user straightens the pattern piece P so the position of the first end of the grain line is established using the guide markings 92 on the guide 80. Once the position of the first end of the pattern piece P is established, that end is secured to the cutting mat assembly 12 and the fabric F with one or more magnets 14. The grain alignment guide 80 is then moved to the other end of the pattern grain line. The grain alignment guide 80 remains perpendicular to the pattern grain line. The user then straightens the pattern piece P so the position of the other end of the grain line is established using the same marking 92 on the guide 80. Once the position of the second end of the pattern piece P is established, that end is secured to the cutting mat assembly 12 and the fabric F with one or more magnets 14.

As an alternative to placing the grain alignment guide 80 perpendicular to the pattern grain line, the guide can be placed parallel to the selvage and the pattern grain line. If the guide 80 is placed parallel to the selvage, magnets 14 are placed in the openings 90 to temporarily hold the guide in place while the pattern pieces P are adjusted. The pattern pieces P are straightened following the edge of the ruler portion 84 of the guide 80 (as opposed to following the markings 92 as described in the alternative perpendicular placement above).

Once the pattern piece P is aligned with the grain line of the fabric F, additional magnets 14 can be placed on the pattern piece to hold it securely in place. Additional pattern pieces P can be placed on the fabric F and aligned as described above. The user then cuts the fabric F in the shape of the pattern pieces P with a rotary cutter R or other suitable device. For example, a 28 mm rotary cutter can be used to cut around curved pattern edges. A smaller cutter can be used to cut or mark notches from the pattern pieces P in the fabric F. A larger rotary cutter (e.g., 45 mm) can be used with thicker or loftier fabrics. After the fabric F is cut and notched according to the pattern pieces P, the magnets 14 can be removed and the cut fabric pieces can be set aside to be sewn.

The magnetic cutting mat assembly 12 can be sold and shipped to customers separately or as part of a kit. In one embodiment, the magnetic cutting mat system 10 includes the magnetic cutting mat assembly 12 and the magnets 14. In another embodiment, the magnetic cutting mat system 10 includes the magnetic cutting mat assembly 12, the magnets 14, and the patternmaker layer 22, sold assembled (with the patternmaker layer attached to the magnetic cutting mat assembly) or disassembled. In another embodiment, the magnetic cutting mat assembly 12, the magnets 14, and one or more of the accessories (e.g., the patternmaker ruler 40, the patternmaker curve 50, the patternmaker hip curve 60, the grain alignment guide 80, and/or the patternmaker square 100) are sold together in a kit. In one embodiment, the magnetic cutting mat assembly 12, the magnets 14, and the grain alignment guide 80 are sold together. Alternatively, the accessories can be sold separately for use with the magnetic cutting system 10, either individually or in any combination. Other configurations and assemblies are within the scope of the present invention.

The magnetic cutting system 10 as described above is versatile and permits a user to quickly and easily place and secure pattern pieces on fabric for cutting. The magnets 14 are strong enough to securely and firmly hold the pattern pieces and the fabric in place during cutting. The accessories described above can also be quickly and firmly secured to the fabric and/or the pattern pieces for easy use. In addition, the accessories for use with the magnetic cutting mat assembly are preferably transparent for better visibility when drawing and making pattern pieces.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products and methods without departing from the scope of the invention, it is intended that all matter contained in the above description and shown in the accompanying drawings shall be interpreted as illustrative and not in a limiting sense.

What is claimed is:

1. A method of making a sewing pattern piece comprising:

placing pattern paper on a magnetic cutting mat assembly comprising a cutting mat, a magnetic layer attached to the cutting mat, and a patternmaker layer attached to the magnetic layer opposite the cutting mat, wherein the pattern paper is placed on the patternmaker layer of the magnetic cutting mat assembly;

placing a patternmaker accessory comprising a plurality of openings configured to receive a plurality of movable magnetic elements on the pattern paper; and securing the patternmaker accessory to the pattern paper and the magnetic cutting mat assembly with the plurality of movable magnetic elements, each of the magnetic elements being positioned within one of the openings above the pattern paper.

2. The method of claim 1, further comprising drawing pattern pieces on the pattern paper using the patternmaker accessory.

* * * * *